United States Patent [19]

Stahlecker

[11] 4,080,775

[45] Mar. 28, 1978

[54] YARN PIECING PROCESS AND APPARATUS FOR AN OPEN END SPINNING ASSEMBLY

[75] Inventor: Fritz Stahlecker, Josef-Neidhartstrasse 18, 7341 Bad Uberkingen, Germany

[73] Assignees: Fritz Stahlecker; Hans Stahlecker, both of Germany

[21] Appl. No.: 729,262

[22] Filed: Oct. 4, 1976

[30] Foreign Application Priority Data

Oct. 3, 1975 Germany ..... 2544209

[51] Int. Cl.[2] ..... D01H 1/12; D01H 1/32

[52] U.S. Cl. ..... 57/34 R; 57/58.89; 57/78; 57/156

[58] Field of Search ..... 57/34 R, 58.89, 78, 57/156

[56] References Cited

U.S. PATENT DOCUMENTS

| | | | |
|---|---|---|---|
| 3,760,576 | 9/1973 | LeChatelier et al. | 57/34 R |
| 3,877,210 | 4/1975 | Seidl | 57/34 R |
| 3,878,671 | 4/1975 | Seidl et al. | 57/34 R |
| 3,892,062 | 7/1975 | Stahlecker et al. | 57/34 R |
| 3,987,610 | 10/1976 | Stahlecker et al. | 57/34 R |

*Primary Examiner*—Richard C. Queisser
*Assistant Examiner*—Charles Gorenstein
*Attorney, Agent, or Firm*—Craig & Antonelli

[57] ABSTRACT

Process and apparatus for yarn piecing in an open end spinning assembly are provided. The individual steps of the yarn piecing process are controlled by a predetermined piecing program whose start is triggered as a function of the running up of a previously braked down spinning rotor, so that a yarn carried back into the spinning rotor will be applied in the spinning rotor to a fiber ring at a time during which the spinning rotor has only reached a revolutionary speed that is below the operating revolutionary speed thereof. In order to avoid imprecisions in the piecing process caused by delays and/or differences in the running up characteristics of the individual spinning rotor, one or more predetermined spinning rotor revolutionary speeds are established, and upon reaching the same, the yarn piecing process is initiated and controlled.

10 Claims, 6 Drawing Figures

YARN PIECING PROCESS AND APPARATUS FOR AN OPEN END SPINNING ASSEMBLY

BACKGROUND AND SUMMARY OF THE INVENTION

The invention relates to process and apparatus for yarn piecing, for an open end spinning assembly, especially by means of a yarn piecing device that is mobile along an open end spinning machine, in which the individual steps of the process are controlled with a program whose start is triggered as a function of the start-up of a previously braked down spinning rotor, so that a yarn carried back in the spinning rotor is pieced to a filament ring taken off in the spinning rotor at a time at which the spinning rotor has only reached an rpm that is below the operational rpm.

The known process (German Offenlegungsschrift 2,321,775) effected by a mobile yarn piecing device has the advantage that even at very high revolutions of the rotor, which may be well above 50,000 $min^{-1}$, a yarn piecing process can be effected. In the known construction, practically all the steps of the process are controlled by a program that determines the temporal relationships of the individual steps of the process. Only the drawing off again of the yarn led back into the spinning rotor or turbine is controlled by a yarn monitor which triggers the drawing off of the yarn when a specific yarn tension is reached. The program itself is started with the release of the brake that brought the spinning rotor to a stop. By means of a delay member, the start up of the program waits until the spinning rotor reaches the desired rpm, on the basis of its running-up curve.

This construction, which in itself is advantageous, still has some imprecisions bscause the running-up curve may differ from one spinning station to the next. These imprecisions are caused essentially by the fact that, before the actual running up of the spinning rotor, certain actuators have to be moved that are not free of delay in their functioning. This is true, for example, of the actuating lever and other setting elements of the spinning rotor brake, as well as the elements that supply the spinning rotor drive. Friction occurs, that differs from spinning station to spinning station. Also, spring elements are used for setting that cannot all be entirely identically designed. It has further been found that there may be different running-up processes on the same spinning assembly, depending upon whether the spinning assembly has been stopped only briefly or for a longer period. The differences in the running-up behavior have the effect that different yarn qualities are produced. Within certain limits these quality differences are insignificant, but it can happen nevertheless that there will be piecers that no longer meet requirements.

The invention is addressed to the problem of developing the process and apparatus of the mentioned type in such a way as to ensure more uniform piecing operations with retention of all the advantages of this process. The invention contemplates providing that the start of the program for the piecing operation is triggered as a function of actual monitored running-up behavior of the spinning rotor. By monitoring the running-up behavior and the starting that depends thereon, the effect of parts that could lead to differences in the speed of the spinning rotor during the actual piecing operation is eliminated.

In developing a first embodiment of the invention, it was provided that the program would start in a predetermined time with its start being triggered by the attaining of a predetermined rpm of the spinning rotor. In this development of the invention, the point of departure was the assumption that the differences in the running-up behavior were essentially caused by elements that had to be actuated before the start, while substantially similar running-up curves are obtained, once the spinning rotor has reached a specific rpm.

In another embodiment of the invention, a plurality of programs are provided with time segments that are different but fixedly related to each other, for the individual steps of the process, whose start and selection is dependent upon the running-up behavior of the spinning rotor, whereby advantageously the running-up behavior is determined by measurement of time segments that are between the reaching of at least two characteristic rpm's by the spinning rotor. With this arrangement it is possible to a certain extent to eliminate the causes of the different running-up curves that occur after the starting of the spinning turbine.

In a further embodiment of the invention it is provided that the individual process steps of the program are triggered with the reaching of a predetermined rpm of the spinning rotor and respectively associated therewith. In this arrangement the starting times for all process steps are referred directly to the existing running-up curve of the spinning rotor of the spinning assembly in question, so that occurrence of irregularities is entirely ruled out for all practical purposes.

These and other objects, features and advantages of the present invention will become more apparent from the followind description when taken in connection with the accompanying drawings, which show, for purposes of illustration only, several embodiments in accordance with the present invention.

DETAILED DESCRIPTION OF THE DRAWINGS

Figure 1:
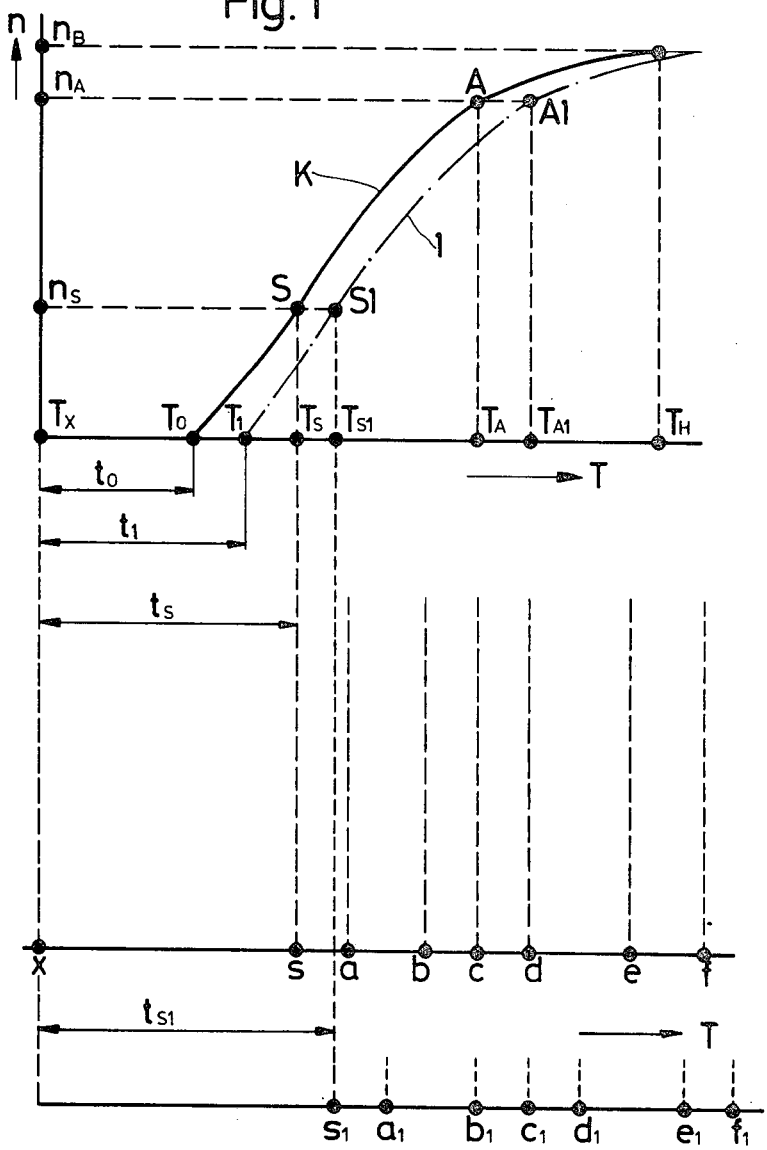
FIG. 1 is a diagram which shows the running-up behavior of a spinning rotor and the relationship thereof to the present invention.

In FIG. 1, the rpm (revolutions per minute) $n$ of a spinning rotor is plotted as curve K over time T during a running-up process. The spinning rotor starting up from a full stop reaches operting rpm $n_B$ at time $T_H$. It has been found that there is an rpm range for example in which piecing can be most reliably accomplished. For the purpose of explaining the invention, it is assumed that point A on running-up curve K defines an optimal piecing time, to which piecing time $T_A$ and piecing rpm $n_A$ are associated. Piecing rpm $n_A$ is distinctly below operating rpm $n_B$.

If the brake of the spinning rotor is released at time $T_X$, after a time segment $T_o$, the actual high-speed running of the spinning rotor (running-up curve K) will begin at time $T_o$. In FIG. 1, there is another dot-and-dash curve 1 of another spinning rotor, where it is assumed that its actual high speed running only begins at time $T_1$. There is then a piecing point $A_1$ associated with this curve 1 which, if it is to occur at the same rotor rpm $n_A$ as in the case of curve K, will lag distinctly behind time $T_A$. It is thus assumed that the two running-up curves K and 1 are per se alike, i.e. that the differences are caused by elements that have to be moved before the actual start of running-up of the spinning rotor.

To balance out the effect of the differences between time segments $t_o$ and $t_1$ in the piecing processes, piecing time $T_A$ or $T_{A1}$ will be measured according to the invention from a specific rotor rpm, designated as starting rpm $n_S$. To this starting rpm $n_S$ there are associated starting points S and $S_1$ respectively on the respective high speed running up curves K and 1, on the assumption that is widely accepted in practice; namely that from starting points S and $S_1$, respectively, the characteristic of curves K and 1 will be essentially identical. For this reason the actual automatic piecing program is only started if the spinning rotor in question has already attained the predetermined starting rpm $n_S$. To each individual high speed curve therefore there is associated a starting time segment, for example time segment $t_s$ with curve K, and time segment $t_{S1}$ with curve 1. The respective piecing programs start from the associated times $T_S$ and $T_{S1}$ respectively, as symbolized for example by the lower-case letters *s, a, b, c, d, e, f* on the one hand or $s_1$, $a_1$, $b_1$, $c_1$, $d_1$, $e_1$ and $f_1$ on the other, at which the individual process steps are started during the piecing, controlled, for example, preferably by a timing switch arrangement.

It is to be recognized that the starting program of curve K begins at point *s*, while the starting program of curve 1 begins at point $s_1$. It should further be observed that the individual time segments between points *s, a, b,* etc. on the one hand and $s_1$, $a_1$, $b_1$, etc., on the other, are equal, and that only the beginning of this program occurs at a different time. In this way it is ensured that piecing will occur at each individual spinning station essentially at the same piecing rpm $n_A$.

Figure 2:
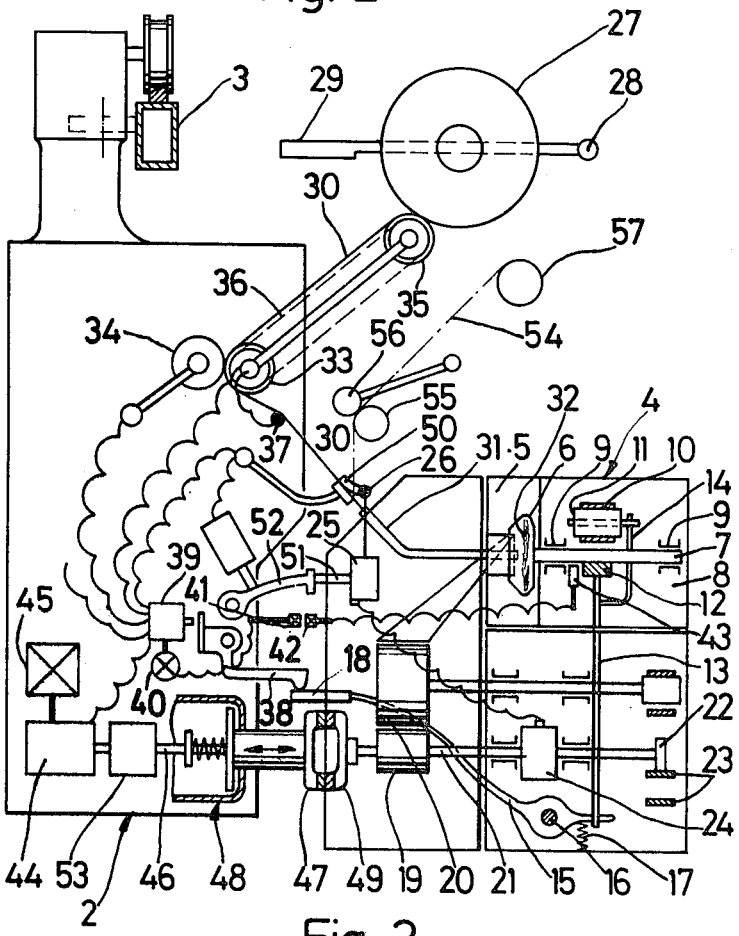
FIG. 2 is a schematic view of a spinning assembly and associated piecing device constructed in accordance with the present invention.

With use of the piecing device as in FIG. 2, starting, according to the invention, can be effected on an open end spinning assembly 4. In the illustrated embodiment, there is a piecing device 2 that is moveable on rails 3 along an open end spinning machine, whereof a spinning station 4 is schematically drawn in section. A spinning rotor or turbine 6 turns as spinning rotor in a vacuum chamber 5, shaft 7 of said turbine being borne in bearings 9 in a housing 8 at the back.

Shaft 7 is driven by a tangential belt 10, with the lower portion, in operation, being thrust by a pressure roll 11 against shaft 7, whereas the upper part runs back on pressure roll 11. In the illustrated braking state, pressure roll 11 is lifted off from turbine shaft 7 along with the lower part of tangential belt 10, the shaft being braked by a brake 12. An actuator rod 13 is provided for brake 12, coupled with a lift-off device 14 for pressure roll 11. Actuator rod 13 of brake 12 is adjustable by means of a double lever 15 that is pivotably mounted at a shaft 16. A spring 17 engages double lever 15, drawing it into its position that releases turbine shaft 7. Double lever 15 extends out beyond spinning assembly 4 with its free arm 18.

Opened fibers are fed to spinning tubine 6. For this, a sliver (not illustrated in order not to obscure the invention) is engaged by a feed roll 19 and delivered to an opening roll 20, whence the opened fibers are taken to spinning turbine 6. Feed roll 19 is connected via a shaft 21 and a toothed gear 22 to a belt 23 that runs in the long direction of the machine. The connection between gear 22 and feed roll 19 is interruptable by an electromagnetic switch coupling 24 that divides shaft 21. Switch coupling 24 is electrically connected with a switch 25 of a yarn monitor 26 that cuts off (interrupts) coupling 24 if there is a yarn break.

The schematically illustrated piecing device 2 takes a yarn end 30 from a winding spool 27 that is swingable by means of a lever 29 about shaft 28, which shaft is fixed on the machine, and delivers the yarn end for piecing via a yarn drawing passage 31 back into spinning turbine 6, in which it is pieced onto a fiber ring 32. Return delivery is effected via auxiliary draw rolls 34 and 33 of piecing device 2, whereof at least roll 33 is drivable in either direction of rotation. Roll 33 is coupled via a chain drive to a lift roll 35 for winding spool 27. Yarn end 30 is sucked by the vacuum that prevails in vacuum chamber 5 into spinning turbine 6. The reversal of the direction of rotation of auxiliary draw roll 33 is controlled by a yarn tension sensor 37 of piecing device 2, according to which the yarn is again drawn off and then transferred to the drive effected by winding roll 57. The program that controls the piecing can supplementarily be so laid out according to the invention that it also influences the redrawing off of the yarn, if, for example, there is provision that the reversal of the direction of rotation can only occur if a specific yarn tension is sensed by yarn tension sensor 37, and a specific yarn rpm or a corresponding time after the start has been reached.

To make the piecing possible at a turbine rpm that is slow with respect to the operating rpm, piecing is effected during the running-up of spinning turbine 6. For this, piecing device 2 is furnished with a switch-on lever 38 that is opposite the free lever arm 18 of double lever 15 of brake 12, when the piecing device 2 is set up precisely on the spinning assembly 4. With release of free arm 18 of brake 12, which also is preferably controlled automatically, switch-on lever 38 will be actuated, actuating in turn a starter switch 39. The starter switch 39 contains a program for the individual successive and partly simultaneous process steps of the piecing process and is connected to a control instrument 40 that is connected to a sensing instrument 41. Sensing instrument 41 is set up on a pulse transmitter 42 of spinning station 4, whereby this pulse transmitter 42 is electrically connected with a measuring probe 43 that is associated with turbine shaft 7 and measures starting rpm $n_S$, without contact. Only after this starting time $T_S$ (corresponding to rpm $n_S$ as explained above referring to FIG. 1) does the switch 39 of piecing device 2 allow the actual automatic piecing program to start. In this way delays that are dependent upon inertia and friction are compensated for.

Starting switch 39 is connected on the one hand to the drive motor of auxiliary draw off rolls 33, 34 and on the other hand to an auxiliary drive whereby delivery roll 19 is so driven that its start-up behavior and therewith the time and/or the amount of sliver feed is adjustable with respect to the rpm of the turbine.

In the illustrated embodiment, the auxiliary drive of piecing device 2 includes an electric regulating motor 44 whose high speed behavior is adjustable via a regulator 45. For this, a slip-ring rotor motor with a special resistance starting circuit or a smooth starting adjustable dc motor is provided. Regulating motor 44 drives a shaft 46 that is connected with a drive gear 47. The connection between shaft 46 and drive gear 47 is effected via a setting device 48 whereby drive gear 47 can be moved axially. Opposite drive gear 47 there is a counter gear 49 that is fixed in rotation with delivery roll 19 and accessible from the outside. Between drive gear 47 and counter gear 49 there may be a toothed or a friction coupling.

Since during the piecing process the drive of the sliver feed occurs via the auxiliary drive of piecing device 2, the main sliver feed drive must be switched off during this period, whereby switch connection 24 remains in its open position. This is preferably controlled, for example, via an electric timing switch member that only closes coupling 24 with a delay, even if the yarn sensor 26 has been returned to its operating setting, which in the illustrated embodiment is effected with a yarn clamp 50 of piecing device 2 that is presented by yarn end 30 of the opening of yarn draw off passage 31.

In the illustrated embodiment a supplementary switching device of piecing device 2 ensures that coupling 24 will remain open, so that here also outlay for the individual spinning assembly remains slight. Switch 25 of yarn monitor 26 is made as a double throw switch for this purpose. This is additionally switchable via a push element 51 in such a way that coupling 24 will remain open. The switching over of the push element is effected via a lever 52 of piecing device 2 associated thereto, which is switched by means of an electric servo device. The said servo device and lever 52 are preferably electrically connected with yarn clamp 50 so that a deviation of yarn sensor 26 by means of yarn clamp 50 into the operating setting will result in actuation of push device 51, so that coupling 24 will remain open. After the piecing switch coupling 24 is closed, so that the main drive of the sliver feed is set going. To prevent mutual damage of the auxiliary and main drives, there is a free wheel 53 incorporated in the auxiliary drive. In this way it is ensured that there will be no irregularity in the transition of the sliver feed from the auxiliary drive to the main drive.

Figure 3:
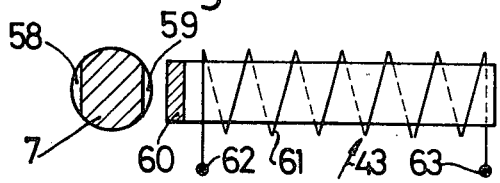
FIG. 3 is a schematic view of a detail of FIG. 2.

FIG. 3 shows schematically how, for example, a no-contact measurement of starting rpm $n_S$ can be effected according to the invention, and therewith indirectly a measurement of starting time $T_S$. Turbine shaft 7 i provided for this purpose, in the region of measuring probe 43 (see FIG. 2) with recesses 58 and 59, respectively, that pass the measurement point 60 of probe 43 in succession, at specific intervals. Pulses are transmitted thereby via a coil 61, depending upon the frequency of the passage of recesses 58, 59 of turbine shaft 7. Terminals 62, 63 are connected with pulse transmitter 42 in a way that will be sensed by detector 41 of piecing device 2. The said detector 41 is, as previously described, connected with starting switch 39, so that the actual automatic piecing program only starts to run if turbine 6 has reached a specific rpm that is below the piecing rpm.

Figure 4:
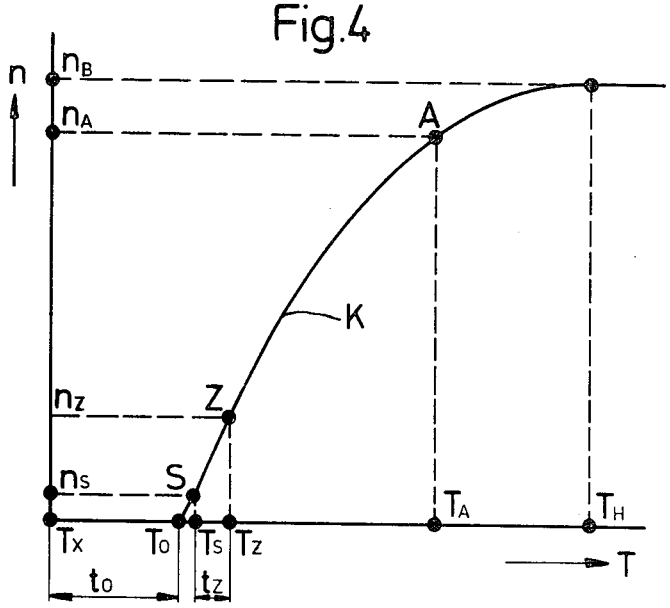
FIG. 4 is a diagram similar to FIG. 1, however, showing a different relationship for a different embodiment of the present invention.

FIG. 4 also shows a high speed running up curve K of spinning turbine 6, in which the turbine rpm $n$ is plotted against time T. At a time $T_H$ measured from time $T_X$ of the release of the turbine brake, the spinning turbine reaches operating rpm $n_B$. Once again it is assumed that piecing occurs at a piecing point A, at a time $T_A$, at a piecing rpm $n_A$. Conditioned by the previously mentioned inertial forces, the actual high speed running of spinning turbine 6 only begins at a time $T_o$, where $t_o$ symbolizes the variable tolerance-conditioned different time spans. In this case, two points of the high speed curve K are measured above the appurtenant rpm, namely point S and point Z. Point S corresponds to starting rpm $n_S$ of FIG. 1, while rpm $n_Z$ characterizes a second control rpm. Point Z may be above or below starting point S, herein schematically depicted as above point S. FIG. 4 further shows that starting point S can be even at a very low turbine rpm $n_S$ and for example even at a time at which the turbine is only beginning to turn. This of course also applies to the representation of FIG. 1.

Measurement of two or more points corresponding to points S and Z of high speed curve k has the advantage that the characteristic of running up curve K (between points S and Z) can be included also, so that effects caused by differences in this curve may also be eliminated. For this, for example, it is provided that the piecing device will include several programs that correspond to different characteristics of running up curve K. The start of the program and at the same time the selection of the most suitable running up curve then occur, depending upon the characteristic of the running up curve that is obtained and evaluated, in the measurement of characteristic rpm's and time segments required for them.

As FIG. 1 shows, times *a, b, c*. . . that correspond to the starting times of the individual process steps are associated with characteristic rpm's on the high speed curve K of the spinning rotor. To eliminate differences in the characteristic of the individual high speed curves, it is further provided, according to certain preferred embodiments of the invention, that the spinning rotor rpm's that are characteristic for these times be measured also and used as start signal for the triggering of the process step in question. For example, a cam roll is provided that would trigger the individual program steps and that would be advanced stepwise by pulses of rpm measurement, whereby the pulses would correspond to the given appurtenant rpm. Further switching would be effected in an embodiment as in FIG. 1, by a timer switch, on the other hand.

Figure 5:
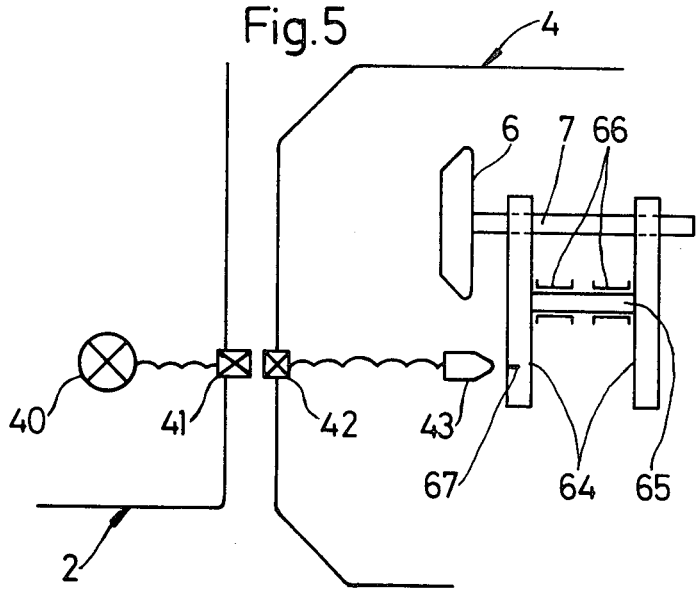
FIGS. 5 and 5A are schematic views showing detail of piecing devices and open end spinning assemblies, constructed in accordance with the present invention.

FIG. 5 schematically shows an embodiment in which shaft 7 of spinning turbine 6 is borne in the wedge gap of two pairs of support rolls 64. Shafts 65 of the pair of support rolls 64 can be held in bearings 66. At least one of support rolls 64 presents a marking 67 that can be determined without contact by a measuring probe 43 disposed on each spinning station, at high speed running of turbine 6. In this embodiment especially, we see that even the running up of support rolls 64, even the very first rotation, can be detected and recorded. The pulses from measuring probe 43 are taken to a pulse transmitter 42 on the hood of spinning station 4, and from there the pulse is received by a sensing device 41 disposed on mobile servicing device 2 and taken further in the previously described way to instrument 40, and from there the starting switch for the piecing program is actuated.

Figure 5A:
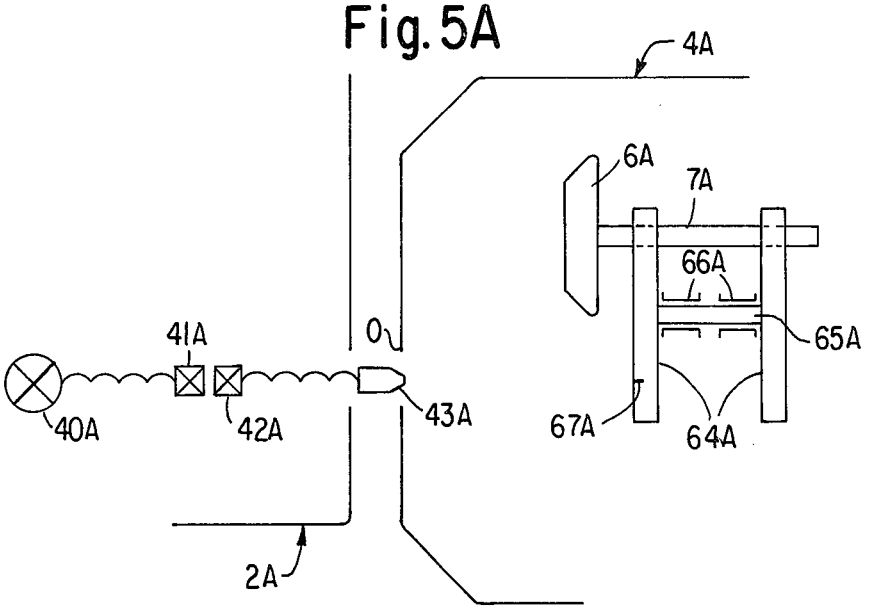

It is also contemplated to change the embodiment of FIG. 5 in such a way, as shown schematically in FIG. 5A which corresponds to FIG. 5 with suffix "A" added to the reference numerals, that probe 43A will be disposed directly on mobile piecing device 2A rather than on the respective spinning stations. The hood of the individual spinning stations 4A would then have to have openings O through which the probe 43A in question, of piecer 2, could be guided to the support roll 64A in question.

While we have shown and described only several embodiments in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

I claim:

1. Process for yarn piecing in an open end spinning assembly on a spinning machine having a plurality of commonly driven spinning assemblies which can be selectively stopped and started independently of one another, where the individual steps of the yarn piecing process are controlled by a predetermined piecing program whose start is triggered as a function of the running up of a previously braked down spinning rotor, so that a yarn carried back into the spinning rotor will be applied in the spinning rotor to a fiber ring at a time during which the spinning rotor has only reached a rotational speed that is below the operating rotational speed thereof, said running up of a previously braked down spinning rotor being separately controllable for each of respective ones of said spinning assembly; said process including the steps of:

monitoring the running up behavior of the spinning rotor, and triggering the start of the piecing program in dependence on the monitored running up behavior, thereby accommodating discrepancies in running up characteristics caused by different friction losses, drive train part tolerances, downtimes, and the like at the respective individual spinning assemblies.

2. Process according to claim 1, wherein said monitoring includes detecting a predetermined rotational speed of the spinning rotor, and wherein said triggering includes triggering the piecing program upon the detection of said predetermined rotational speed, said piecing program actually starting the predetermined operation a predetermined time after said triggering.

3. Process according to claim 1, wherein a plurality of programs with different time segments are provided for the individual process steps, said programs being fixedly subordinated to each other, the start and selection of which programs occur depending upon the running up behavior of the spinning rotor, whereby advantageously the running up behavior and time segments between the attaining of at least two characteristic rotational speeds of the spinning rotor are measured.

4. Process as in claim 1, wherein the individual process steps of the program are triggered with the attaining of predetermined and respectively associated rotational speeds of the spinning rotor.

5. Process according to claim 1, wherein said piecing process is carried out by means of a piecing device moveable along the open end spinning machine for servicing a plurality of separate individual spinning units.

6. Apparatus for yarn piecing in an open end spinning assembly on a spinning machine having a plurality of commonly driven spinning assemblies which can be selectively stopped and started independently of one another, where the individual steps of the yarn piecing process are controlled by a predetermined piecing program whose start is triggered as a function of the running up of the previously braked down spinning rotor, so that a yarn carried back into the spinning rotor will be applied in the spinning rotor to a fiber ring at a time during which the spinning rotor has only reached a rotational speed that is below the operating rotation speed thereof, said running up of a previously braked down spinning rotor being separately controllable for each of respective ones of said spinning assemblies; said apparatus including:

means for monitoring the running up behavior of the spinning rotor, and means for triggering the start of the piecing program in dependence on the monitored running up behavior, thereby accommodating discrepancies in running up characteristics caused by different friction losses, drive train part tolerances, downtimes, and the like at the respective individual spinning assemblies.

7. Apparatus according to claim 6, wherein said means for monitoring includes a signal transmitter that measures the rotational speed of the spinning rotor or a structural part moveable therewith in a predetermined relationship, said signal transmitter being connected with a signal receiver incorporated in the apparatus for carrying out the piecing program.

8. Apparatus according to claim 7, wherein the signal transmitter is incorporated in each spinning assembly, which transmitter is associated with a pulse transmitter to which there is associated a pulse receiver of a mobile yarn piecing device, which yarn piecing device carries out the piecing process.

9. Apparatus according to claim 7, wherein said piecing operation is carried out by a mobile yarn piecing device said mobile yarn piecing device is equipped with a signal transmitter and a setting device, said signal transmitter being adjustable by means of the setting device with reference to the spinning rotor or to a rotating structural part that turns in a given relationship to the spinning rotor.

10. Apparatus according to claim 6, wherein said piecing operation is carried out by a mobile yarn piecing device which is mounted for movement adjacent a plurality of individual spinning units for servicing same, wherein said piecing device includes an auxiliary drive unit selectively engageable to rotatably drive the feed roll, and wherein said monitoring means includes means for determining the exact instance at which the spinning rotor reaches a predetermined rotational speed during the acceleration thereof from a braked condition to an operational rotational speed.

* * * * *